US005717152A

United States Patent [19]

Liao

[11] Patent Number: 5,717,152

[45] Date of Patent: Feb. 10, 1998

[54] CONTROL DEVICE OF A HI-HAT CYMBAL

[75] Inventor: Tsun-Chi Liao, Taichung, Taiwan

[73] Assignee: Hwa Shin Musical Instrument Co., Ltd., Taichung, Taiwan

[21] Appl. No.: 647,456

[22] Filed: May 7, 1996

[51] Int. Cl.[6] ..... G10D 13/02

[52] U.S. Cl. ..... 84/422.3

[58] Field of Search ..... 84/422.3, 402, 84/422.1, 422.2

[56] References Cited

U.S. PATENT DOCUMENTS 4,976,181 12/1990 Hsieh ..... 84/422.3
4,977,810 12/1990 Hsieh ..... 84/422.3
5,266,733 11/1993 Jacobson ..... 84/422.3

*Primary Examiner*—Cassandra C. Spyrou
*Attorney, Agent, or Firm*—Bacon & Thomas

[57] ABSTRACT

A control device coupled between the pull rod of the stand of a hi-hat cymbal and the foot pedal thereof and driven by the foot pedal to operate the cymbals of the hi-hat cymbal, the device including a coupling block coupled to the pull rod of the stand of the hi-hat cymbal by a universal joint and suspended in a base frame to hold two balance bars, a first connecting block and a second connecting block transversely connected between the balance bars at two opposite sides, a linking mechanism coupled between the first connecting block and the foot pedal, and a counterweight coupled between the second connecting block and a locating block to keep the balance bars in horizontal when the foot pedal is not depressed.

3 Claims, 8 Drawing Sheets

CONTROL DEVICE OF A HI-HAT CYMBAL

BACKGROUND OF THE INVENTION

The present invention relates to hi-hat cymbals, and relates more specifically to the control device of a hi-hat cymbal which is coupled between the pull rod of the stand of the hi-hat cymbal and the foot pedal thereof and driven by the foot pedal to operate the cymbals.

A regular hi-hat cymbal, as shown in FIG. 1, is generally comprised of a stand, a pull rod axially sliding in the stand, a lower cymbal fixedly secured to the stand, an upper cymbal fixedly secured to the pull rod and suspending above the lower cymbal, a foot pedal pivoted to the stand, and a control device mounted in the stand and coupled between the pull rod and the foot pedal. When the foot pedal is depressed, the control device is forced to pull the pull rod downwards, causing the upper cymbal to strike the lower cymbal in making a sound. The hi-hat cymbal further comprises a spring installed in the stand to automatically push the pull rod back to its former position when the foot pedal is released. The control device comprises a base frame coupled to the stand of the hi-hat cymbal, a connector coupled to the bottom end of the pull rod of the hi-hat cymbal, and a chain coupled between the connector and the foot pedal. In order to facilitate the downward stroke of the pull rod, the spring power of the spring must be limited. However, if the spring power of the spring is made less strong, the spring cannot quickly force the pull rod back to its former position when the foot pedal is released. Therefore, the operator tends to apply more pressure to the foot pedal during the operation.

SUMMARY OF THE INVENTION

The present invention eliminates the aforesaid problem. According to the present invention, the control device comprises a coupling block coupled to the pull rod of the stand of the hi-hat cymbal by a universal joint and suspended in a base frame to hold two balance bars, a first connecting block and a second connecting block are transversely connected between the balance bars at two opposite sides, a linking mechanism coupled between the first connecting block and the foot pedal, and a counterweight coupled to the second connecting block to keep the balance bars in horizontal when the foot pedal is not depressed. When the foot pedal is released after each operation, the counterweight automatically pulls the balance bars to the balanced position. Therefore, the operator can operate the hi-hat cymbal with less effort.

DETAILED DESCRIPTION OF THE PREFERRED EMBODIMENT

Figure 1:
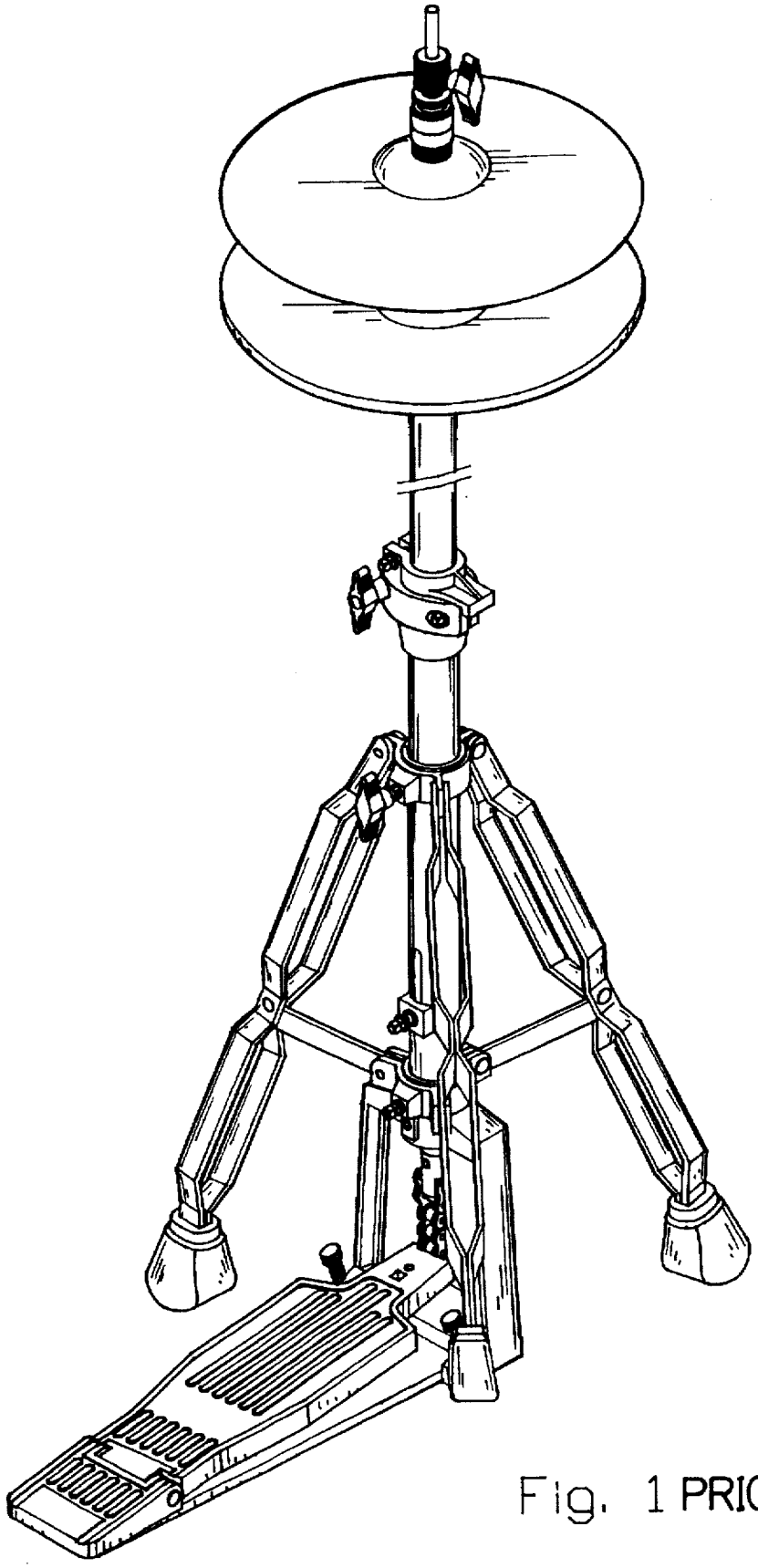
Fig. 1 PRIOR ART
FIG. 1 is an elevational view of a conventional hi-hat cymbal.
Figure 2:
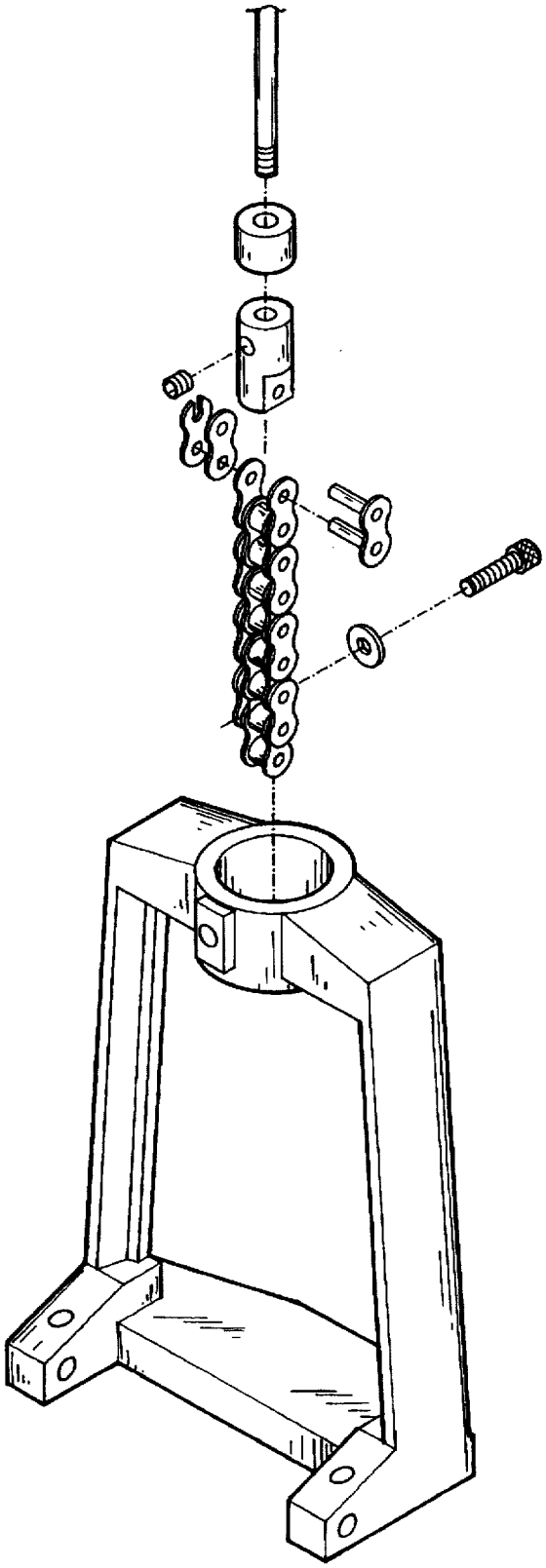
Fig. 2 PRIOR ART
FIG. 2 is an exploded view of the control device used in the hi-hat cymbal shown in FIG. 1.
Figure 3:
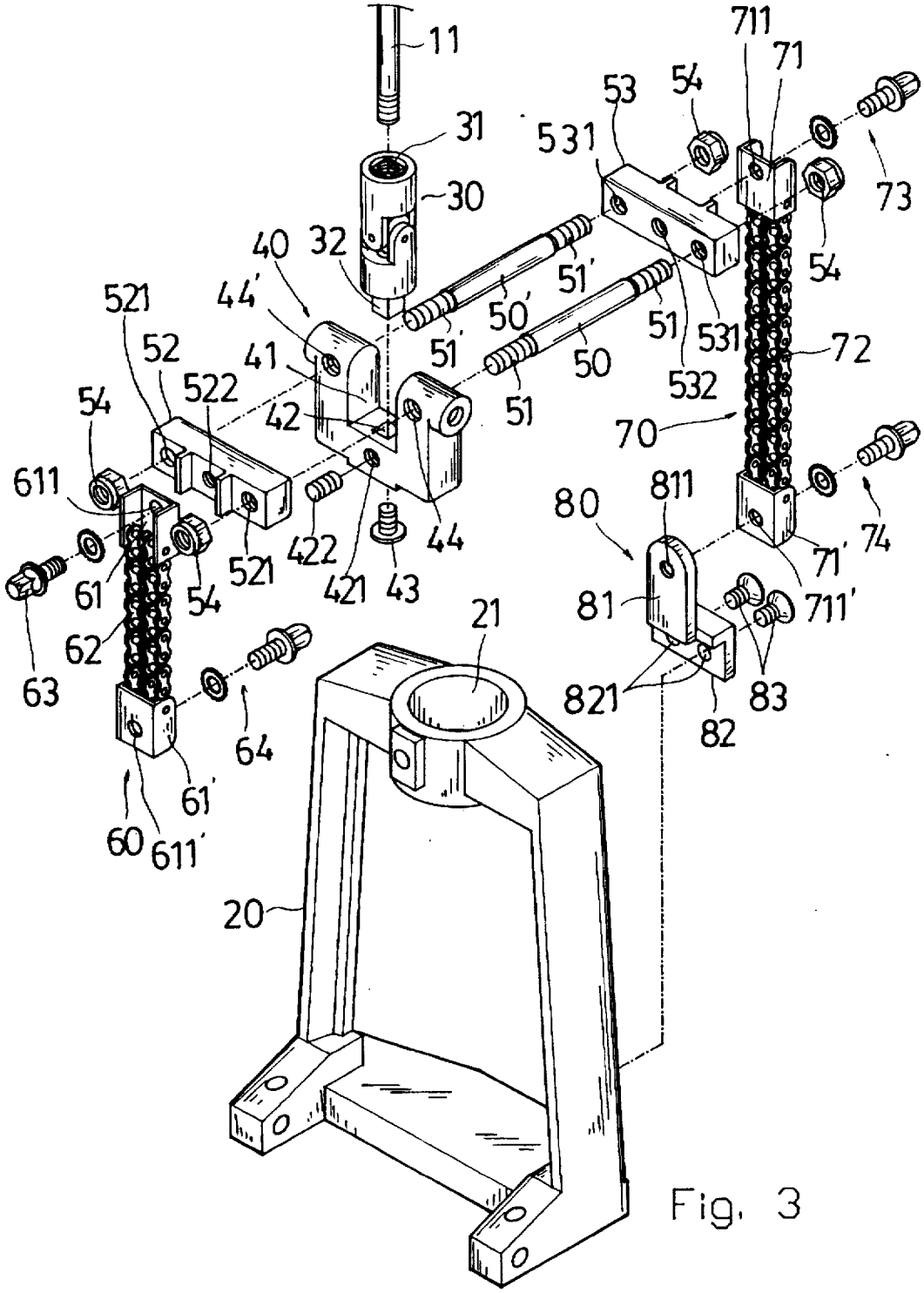
FIG. 3 is an exploded view of a control device for use in a hi-hat cymbal according to the present invention.
Figure 4:
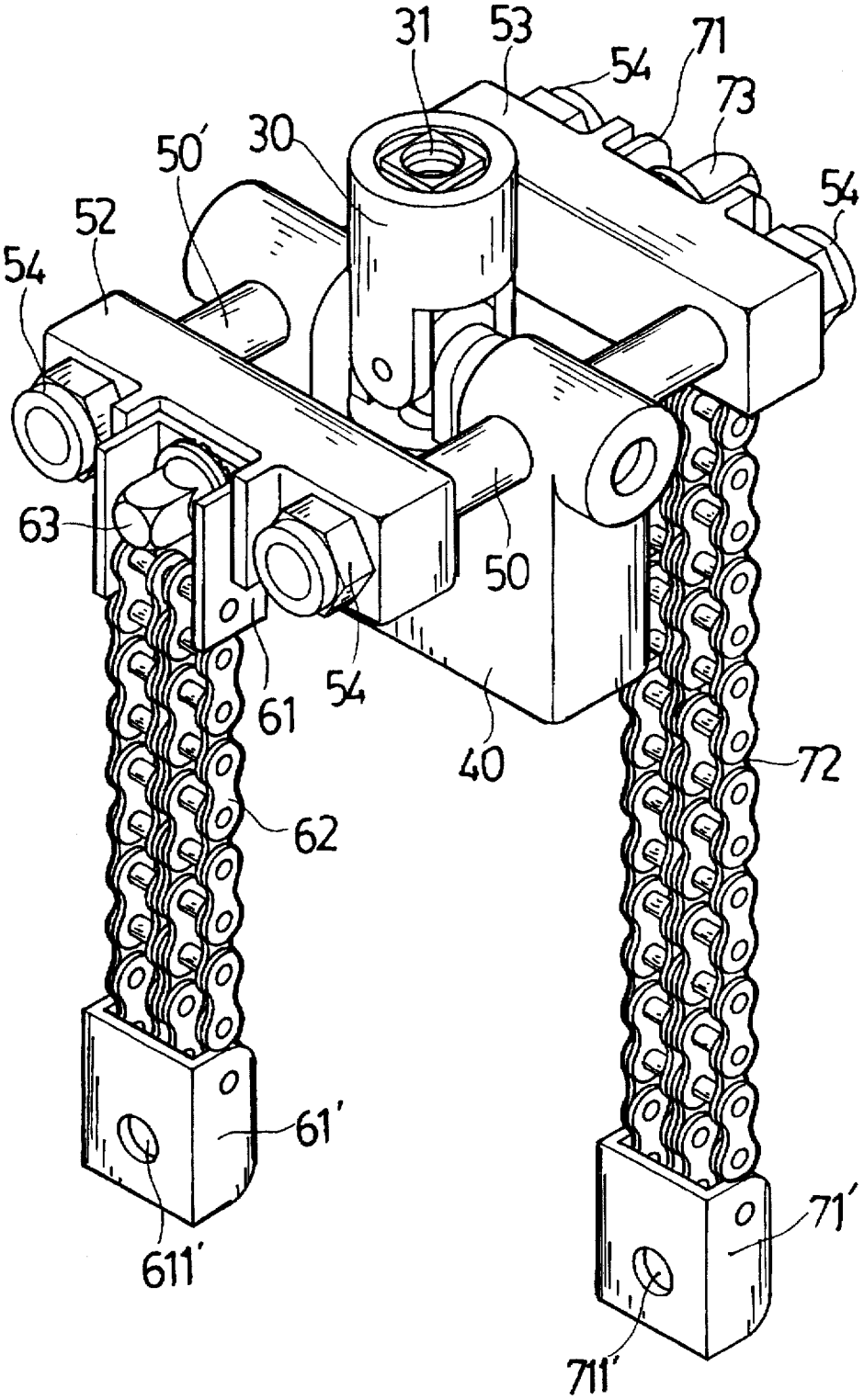
FIG. 4 is an assembly view of the control device shown in FIG. 3 (the base frame excluded)
Figure 5:
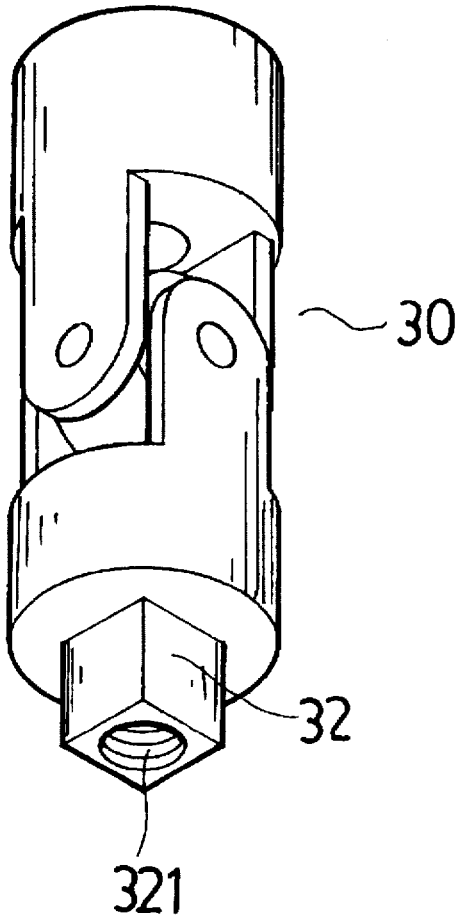
FIG. 5 is an elevational view of the universal joint used in the control device shown in FIG. 3.
Figure 6:
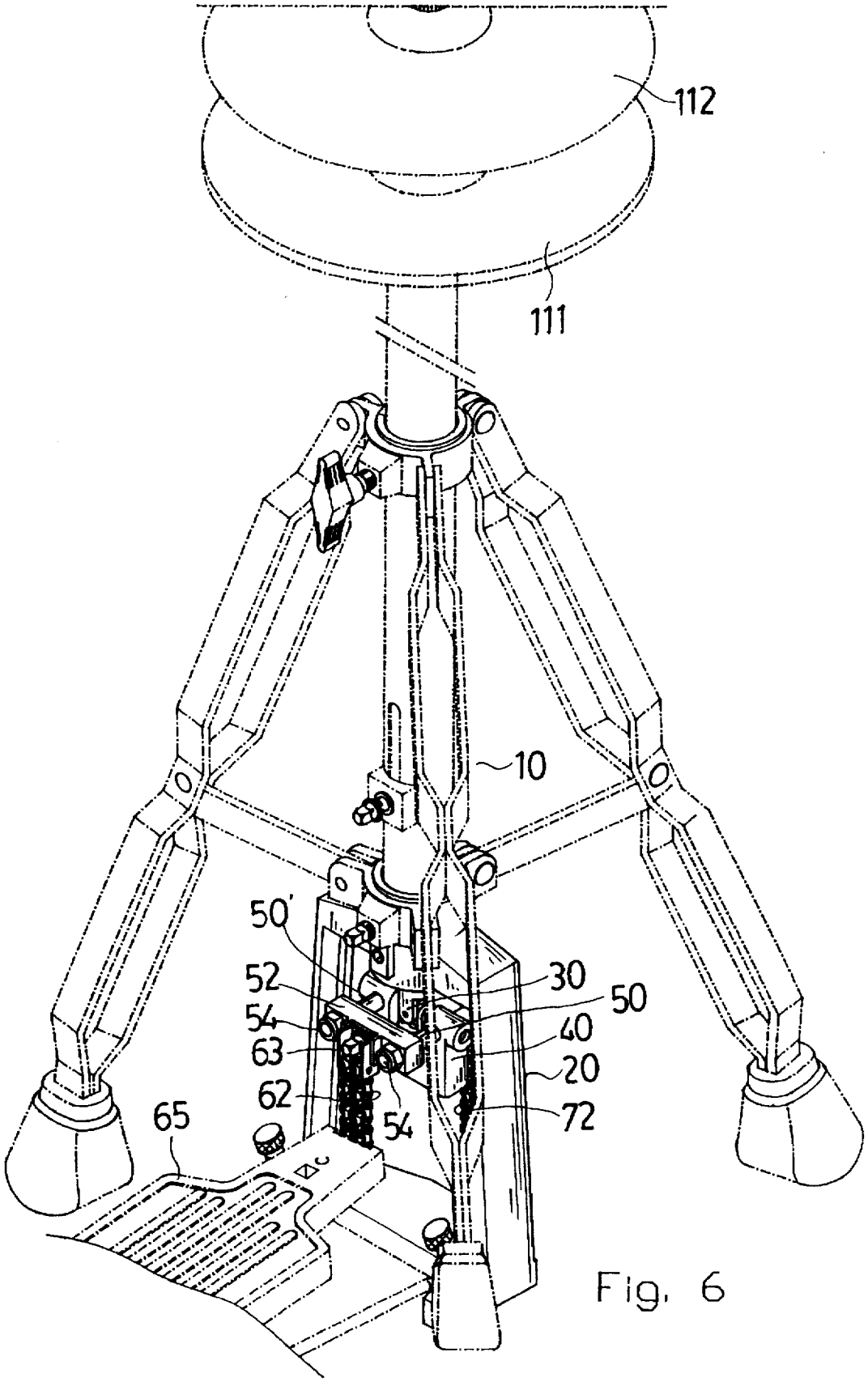
FIG. 6 is an installed view of the present invention, showing the control device installed in the stand of the hi-hat cymbal.

Referring to FIGS. 3, 4, 5, and 6, the control device of a hi-hat cymbal in accordance with the present invention is generally comprised of a base frame 20, a universal joint 30, a coupling block 40, two balance bars 50, 50', two connecting blocks including a first connecting block 52 and a second connecting block 53, a linking mechanism 60, a counterweight device 70, and a locating block 80. The base frame 20 comprises an annular coupling portion 21 at the top adapted for receiving a of the threaded pull rod 11 of a cymbal stand 10 therethrough. The universal joint 30 comprises a screw hole 31 at the top adapted for threading onto the threaded pull rod 11 of the cymbal stand 10, and a coupling rod 32 at the bottom. The coupling rod 32 has a mounting hole 321 axially disposed at the bottom (see FIG. 5). The coupling block 40 comprises a top opening 41 in the middle, a vertical coupling hole 42 disposed at the bottom of the top opening 41 and adapted to receive the coupling rod 32 of the universal joint 30, a fastening element 43 installed in the bottom side thereof and fastened to the mounting hole 321 of the coupling rod 32 to secure the coupling rod 32 to the inside of the vertical coupling hole 42, a horizontal screw hole 421 perpendicularly connected to the vertical coupling hole 42, a tightening up screw rod 422 threaded into the horizontal screw hole 421 to hold down the coupling rod 32 of the universal joint 30 in the vertical coupling hole 42, and two horizontal through holes 44, 44' at two opposite sides of the top opening 41. The balance bars 50, 50' are respectively inserted through the horizontal through holes 44, 44', each having two screw rods 51, 51' at two opposite ends. The connecting blocks 52, 53 are respectively coupled to the balance bars 50, 50' at two opposite sides relative to the coupling block 40. Each connecting block 52 or 53 has two side through holes 521 or 531 at two opposite sides adapted for receiving the screw rods 51, 51' of the balance bars 50, 50', and a center through hole 522 or 532. When the screw rods 51, 51' of the balance bars 50, 50' are respectively inserted through the side through holes 521, 531 of the connecting blocks 52, 53, nuts 54 are respectively threaded onto the screw rods 51, 51' to secure the connecting blocks 52, 53 in place. The linking mechanism 60 comprises a top mounting plate 61, a bottom mounting plate 61', and a chain 62 connected between the mounting plates 61, 61'. The top mounting plate 61 of the linking mechanism 60 has a through hole 611 connected to the center through hole 522 of the first connecting block 52 by a fastening element 63. The bottom mounting plate 61' of the linking mechanism 60 has a through hole 611' connected to the foot pedal 65 of the hi-hat cymbal by a fastening element 64. The counterweight device 70 comprises a top mounting plate 71, a bottom mounting plate 71', and a chain 72 connected between the mounting plates 71, 71'. The top mounting plate 71 of the counterweight device 70 has a through hole 711 connected to the center through hole 532 of the second connecting block 53 by a fastening element 73. The bottom mounting plate 71' of the counterweight device 70 has a through hole 711' connected to the locating block 80 by a fastening element 74. The locating block 80 comprises a mounting base 82 having a plurality of mounting holes 821 respectively fastened to the base frame 20 near its bottom by respective fastening elements 83, an upright plate 81 raised from the mounting base 82 and having a mounting hole 811 connected to the through hole 711' of the bottom mounting plate 71' of the counterweight device 70.

Figure 7A:
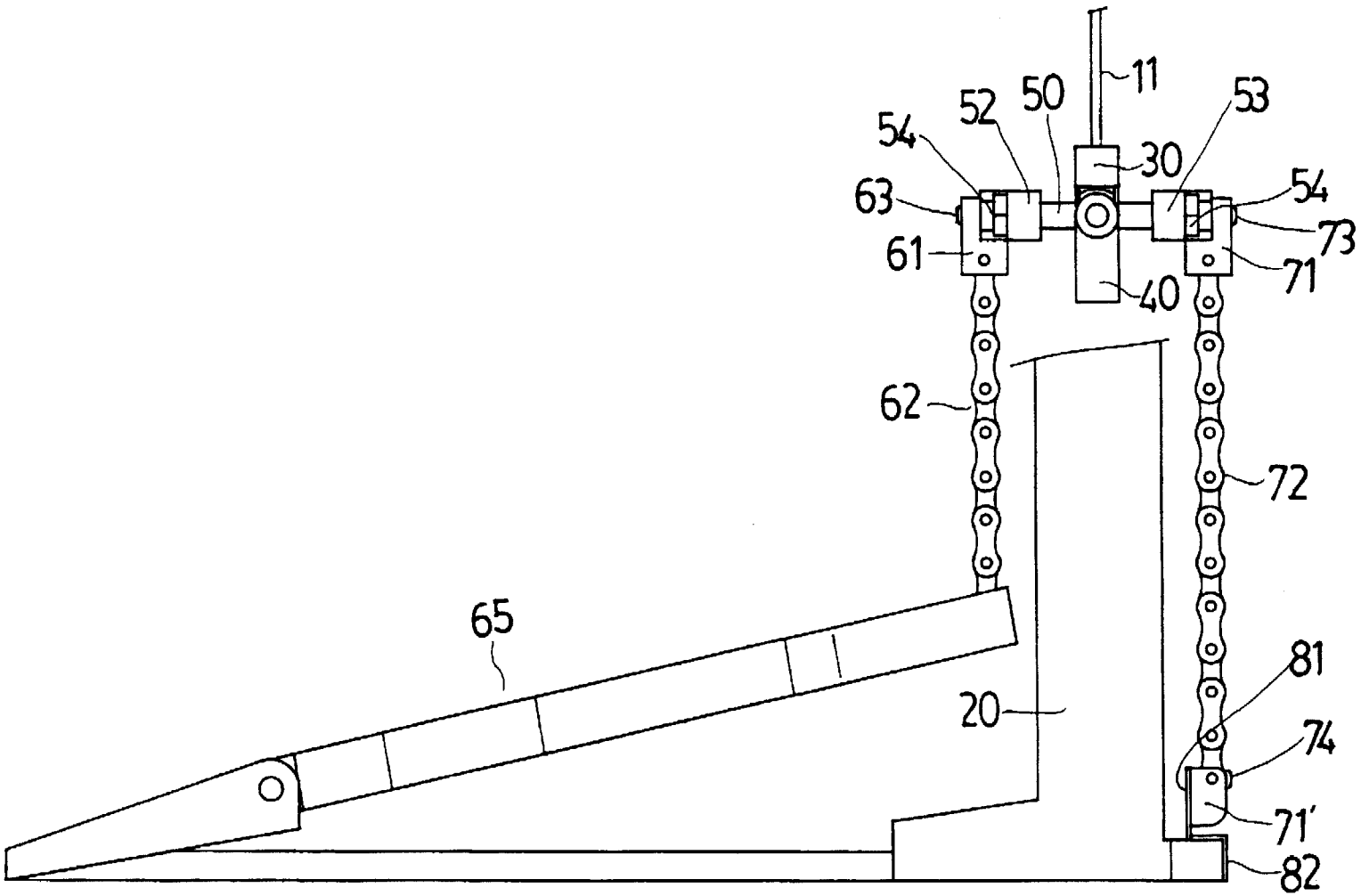
FIG. 7A is a side view of the present invention, showing the balance bars maintained in horizontal.
Figure 7B:
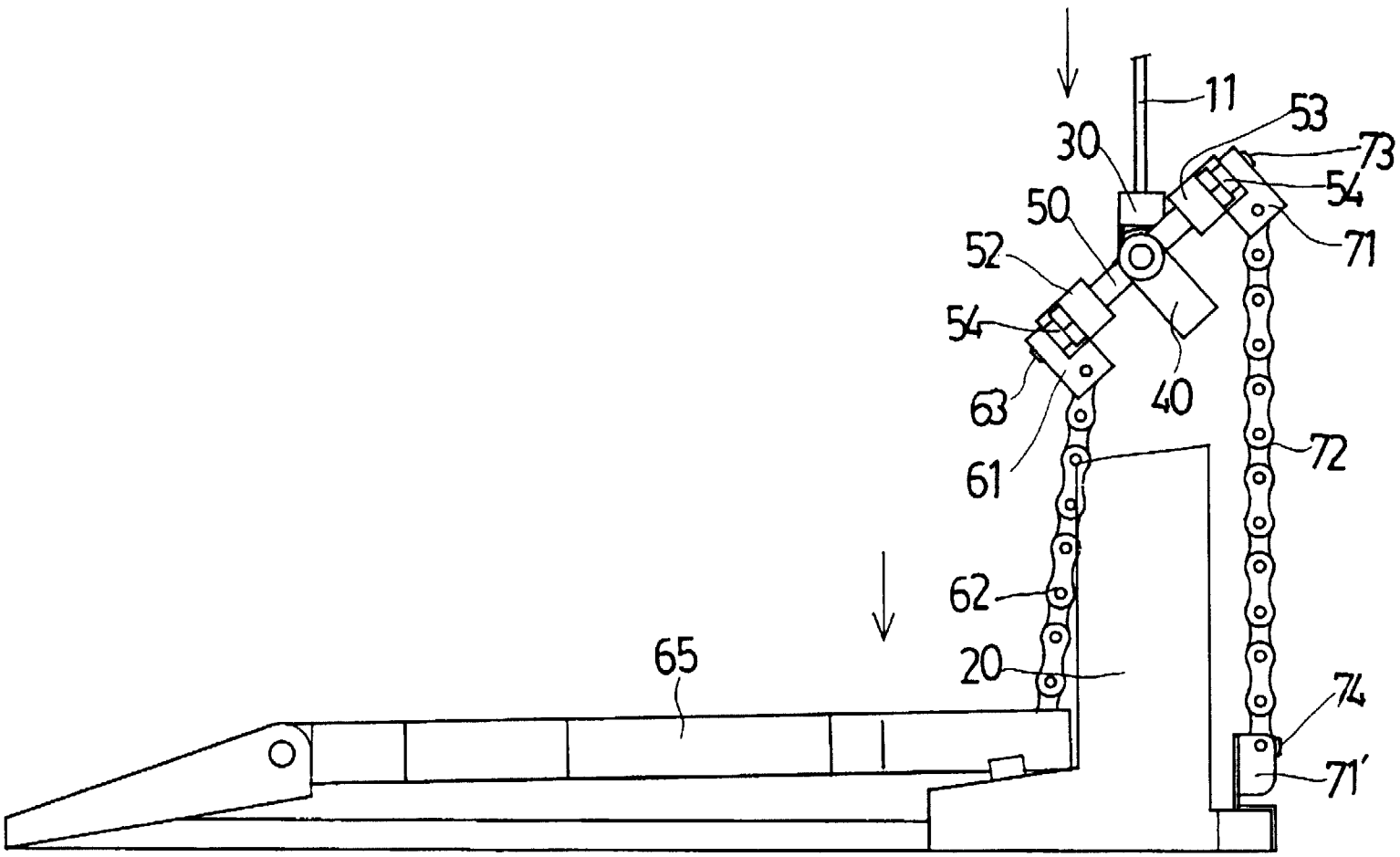
FIG. 7B is another side view of the present invention, showing the foot pedal depressed, the balance bars and the coupling block tilted, and the pull rod lowered.

Referring to FIGS. 7A and 7B, and FIG. 6 again, when the foot pedal 65 is not operated, the balance bars 50, 50' are maintained in horizontal, the coupling block 40 is maintained in vertical without pulling the pull rod 11 (see FIG. 7A). When the foot pedal 65 is depressed, the linking mechanism 60 is pulled downwards to tilt the balance bars 50, 50' and the coupling block 40 (see FIG. 7B). When the coupling block 40 is tilted, the universal joint 30 is forced to pull the pull rod 11 downwards, causing the upper cymbal 112 to be suddenly lowered to strike the lower cymbal 111 in making a clashing sound. When the foot pedal 65 is released, the pull rod 11 is returned to its former position by the spring means inside the cymbal stand 10, and at the same time the gravity weight of the counterweight device 70 forces the linking mechanism 60 to return to its former position, and therefore the balance bars 50, 50' are returned to the balanced position.

I claim:

1. A control device coupled between a pull rod of a stand of a hi-hat cymbal and a foot pedal thereof and driven by the foot pedal to operate a pair of cymbals of the hi-hat cymbal, the control device comprising:

a base frame having an annular coupling portion adapted for receiving the pull rod of the cymbal stand therethrough;

a universal joint having a top end provided with a screw hole fastened to the pull rod of the cymbal stand and a bottom end terminating in a coupling rod;

a coupling block coupled to said universal joint and suspended in said base frame, said coupling block comprising a top opening, a vertical coupling hole disposed in said top opening and coupled to the coupling rod of said universal joint, a horizontal screw hole perpendicularly connected to said vertical coupling hole, a tightening up screw rod threaded into said horizontal screw hole to hold down the coupling rod of said universal joint in said vertical coupling hole, and two horizontal through holes at two opposite sides of said top opening;

two balance bars respectively inserted through the horizontal through holes of said coupling block, each of said balance bars having two screw rods at two opposite ends thereof;

a first connecting block and a second connecting block respectively connected between the screw rods of said balance bars by nuts and disposed in parallel to said coupling block at two opposite sides thereof, said connecting blocks having respective through holes adapted for passing the screw rods of said balance bars therethrough;

a linking mechanism having a top end connected to said first connecting block and a bottom end coupled to the foot pedal of the hi-hat cymbal; and counterweight means coupled to said second connecting block to maintain said balance bars in a horizontal position.

2. The control device of claim 1 wherein said linking mechanism comprises a top mounting plate fixedly connected to said first connecting block, a bottom mounting plate fixedly connected to the foot pedal of the hi-hat cymbal, and a chain connected between the top and bottom mounting plates of said linking mechanism.

3. The control device of claim 1 further including a locating block secured to the base frame and wherein said counterweight means comprises a top mounting plate fixedly connected to said second connecting block, a bottom mounting plate fixedly connected to the locating block, and a chain connected between the top and bottom mounting plates of said counterweight means.

* * * * *